US006676001B1

(12) United States Patent
Chen et al.

(10) Patent No.: US 6,676,001 B1
(45) Date of Patent: Jan. 13, 2004

(54) SCREW POSITIONING DEVICE FOR A SCREW DRIVING GUN

(76) Inventors: Diing-Shen Chen, No. 155, Hui-Min Rd., Nan-Tzu Dist., Kahosiung City (TW); Ru-Ling Chen, No. 155, Hui-Min Rd., Nan-Tzu Dist., Kahosiung City (TW)

( * ) Notice: Subject to any disclaimer, the term of this patent is extended or adjusted under 35 U.S.C. 154(b) by 0 days.

(21) Appl. No.: 10/392,530

(22) Filed: Mar. 20, 2003

(51) Int. Cl.[7] ..... B25B 23/06
(52) U.S. Cl. ..... 227/119; 227/136; 81/434
(58) Field of Search ..... 227/119, 135, 227/136, 137, 138, 139, 120, 109; 81/434, 57.37; 173/4, 11

(56) References Cited

U.S. PATENT DOCUMENTS 5,402,695 A * 4/1995 Hornung ..... 81/434
5,671,645 A * 9/1997 Murayama et al. ..... 81/434
5,934,162 A * 8/1999 Habermehl ..... 227/136
6,089,437 A * 7/2000 Blacket et al. ..... 227/136
6,296,166 B1 * 10/2001 Huang ..... 227/119

* cited by examiner

*Primary Examiner*—Scott A. Smith
(74) *Attorney, Agent, or Firm*—Rosenberg, Klein & Lee

(57) ABSTRACT

A screw positioning device includes a tubular member coupled to a slidable barrel part of a screw driving gun. The tubular member defines a screw-guiding chamber. Two spring-biased screw-holding units are disposed within the chamber, and include two urging members and two screw-holding members urged by the urging members in such a manner that the screw-holding members come into contact with a screw in the chamber and are pushed by the screw to move radially away from each other and that the screw-holding members are urged by the urging members to abut against the screw.

5 Claims, 7 Drawing Sheets

SCREW POSITIONING DEVICE FOR A SCREW DRIVING GUN

BACKGROUND OF THE INVENTION

1. Field of the Invention

The invention relate to a screw positioning device, more particularly to a screw positioning device for a screw driving gun.

2. Description of the Related Art

Referring to FIGS. 1 and 2, a conventional screw driving gun 1 is shown to be adapted for use with a screw feed belt 16 that has a belt body 160 and a plurality of screws 161 detachably retained on the belt body 160. The screw driving gun 1 includes a gun housing 11, a stationary barrel part 12, a slidable barrel part 14, a screw-driving shaft 13, and a positioning member 15.

As illustrated, the stationary barrel part 12 is secured to and projects outwardly from the gun housing 11, and defines a shaft-receiving chamber 120 to receive the screw-driving shaft 13 therein. The slidable barrel part 14 is mounted slidably on the stationary barrel part 12, defines a screw-receiving chamber 141 for receiving the screw 161 that is fed into the screw-receiving chamber 141 in a transverse direction relative to an axis of the screw-driving shaft 13. The screw 191 extends out of the slidable barrel part 14 upon sliding movement of the slidable barrel part 14 toward the gun housing 11. The positioning member 15 is secured to a front end of the slidable barrel part 14 for abutting against the surface 170 of a work piece 17 that rests on a wall structure 18 so that the work piece 17 can be fastened an the wall structure is when the screw 161 is driven and rotated by the screw-driving shaft 13 upon operation of the screw driving gun 1.

A disadvantage of the conventional screw driving gun 1 resides in that, in case the screw 161 has a relatively long length, the belt body 160 is unable to maintain the orientation of the screw 161 along an axis of the screw-driving shaft 13. Thus, inclination of the screw 161 relative to the axis of the is screw-driving shaft 13 by virtue of gravity will occur.

SUMMARY OF THE INVENTION

Therefore, the object of this invention is to provide a screw positioning device that is used in a screw driving gun and that in provided with spring-biased screw-holding units to overcome the aforesaid disadvantage of the prior art.

The screw positioning device of the present invention is used in a screw driving gun that includes a gun housing, a screw-driving shaft, and a barrel unit. The barrel unit has a stationary barrel part secured to and projecting outwardly from the gun housing so as to define a shaft-receiving chamber for receiving the screw-driving shaft therein, and a slidable barrel part mounted on and slidable relative to the stationary barrel part. The slidable barrel part defines a screw-receiving chamber for receiving a screw that is detachably retained on a belt and that is fed into the screw-receiving chamber in a transverse direction relative to an axis of the screw-driving shaft. The screw is driven by the screw-driving shaft, and extends out of the slidable barrel part upon sliding movement of the slidable barrel part toward the gun housing. Accordingly, the screw positioning device of the present invention includes: a tubular member having a coupling end adapted to be connected co-axially to the slidable barrel part for co-movement therewith relative to the screw, a discharge end opposite to the coupling end, and a peripheral wall extending between the discharge and coupling ends and defining a screw-guiding chamber therein. The tubular member is slidable together with the slidable barrel part relative to the screw along the axis to a discharging position, in which the screw extends into the screw-guiding chamber. Two opposing spring-biased screw-holding units are disposed within the screw-guiding chamber, are mounted on the peripheral wall of the tubular member, and include first and second urging members and first and second screw-holding members which radially project from the peripheral wall into the screw-guiding chamber and which are respectively urged by the first and second urging members to move toward each other in such a manner that the first and second screw-holding members come into contact with and are pushed by the screw to move radially away from each other against urging action of the first and second urging members and that the first and second screw-holding members are urged by the first and second urging members to abut against the screw when the tubular member is slid to the discharging position, thereby positioning the screw at a center position, in which the screw extends along the axis.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENTS

Figure 1:
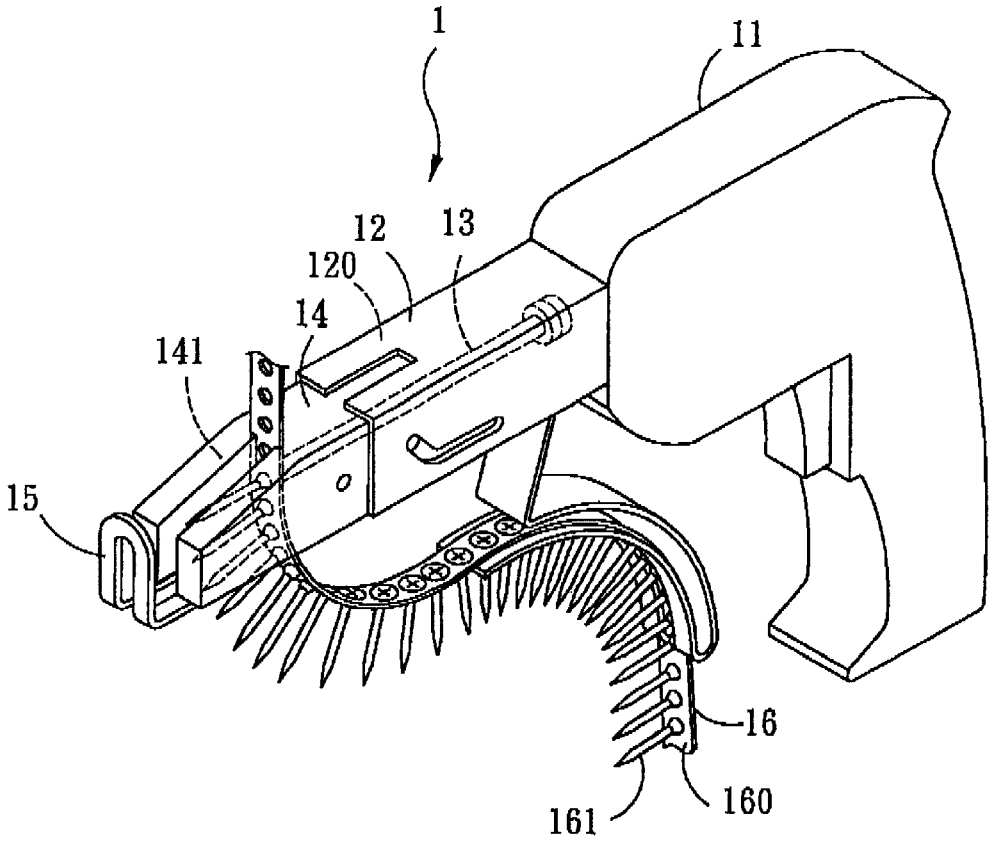
FIG. 1 PRIOR ART
FIG. 1 is a perspective view of a conventional screw driving gun.
Figure 2:
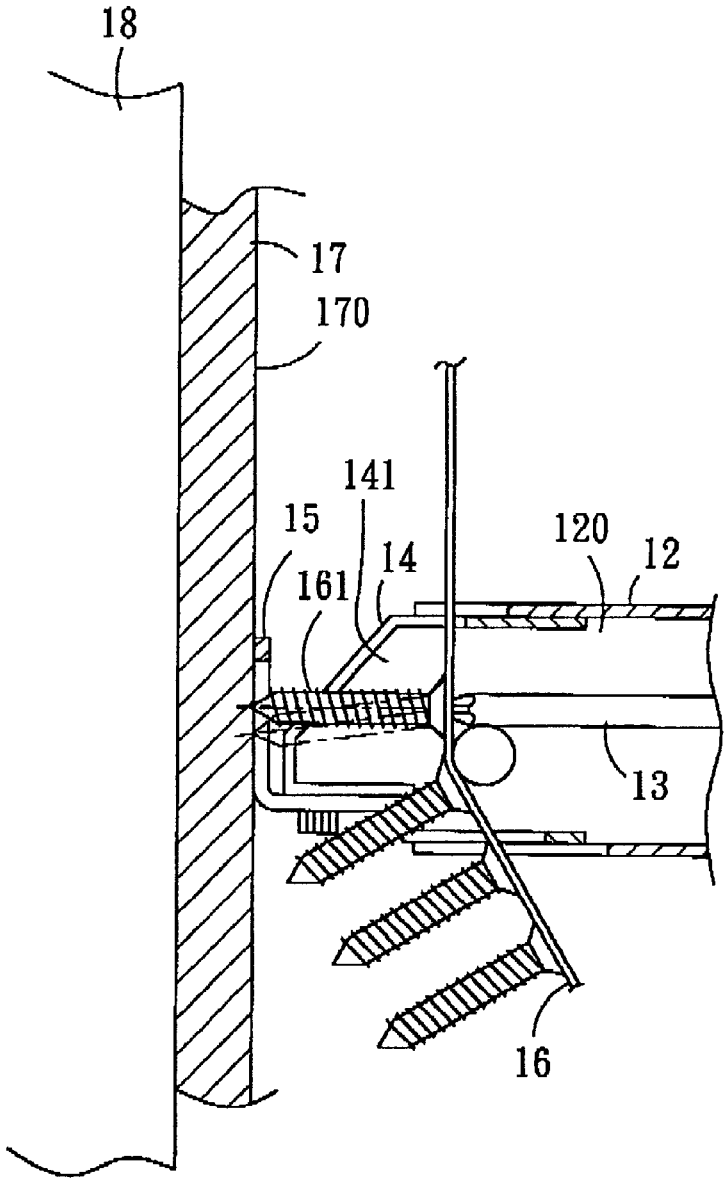
FIG. 2 PRIOR ART
FIG. 2 illustrates the conventional screw driving gun of FIG. 1 in a state of use.
Figure 3:
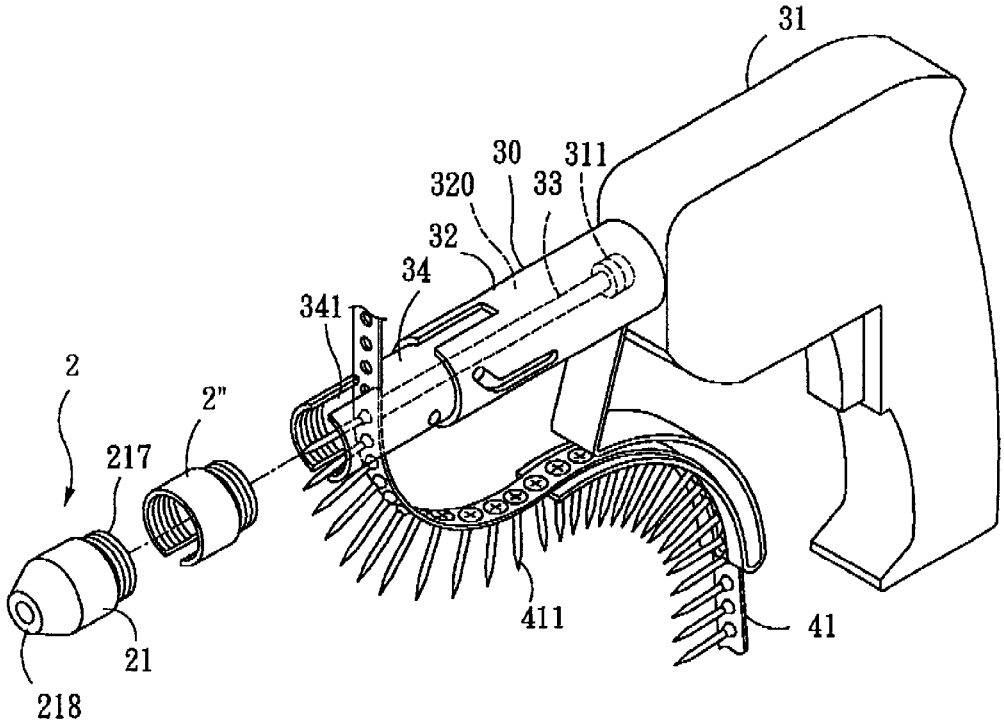
FIG. 3 is a perspective view of the first preferred embodiment of a screw positioning device according to the present invention used in a screw driving gun.
Figure 4:
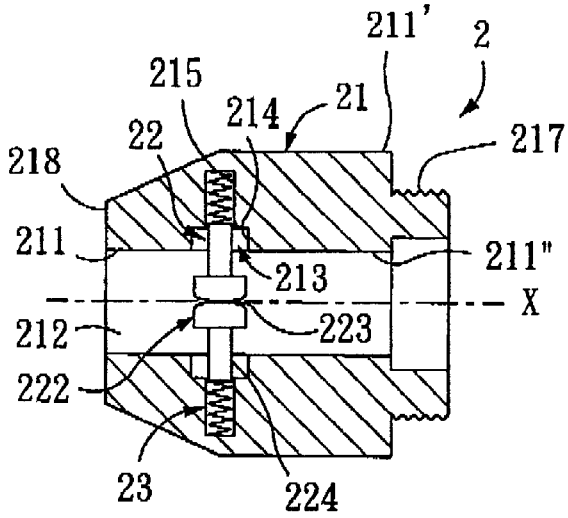
FIG. 4 is a sectional view of the first preferred embodiment.

Referring to FIGS. 3 and 4, the preferred embodiment of a screw positioning device 2 of the present invention is used with a screw driving gun that includes a gun housing 31, a screw-driving shaft 33, and a barrel unit 30. The preferred embodiment, accordingly, includes a tubular member 21 and at least two opposing spring-biased screw-holding units 22.

As illustrated, the barrel unit 30 has a stationary barrel part 32 secured to and projecting outwardly from the gun housing 31 so as to define a shaft-receiving chamber 320 for receiving the screw-driving shaft 33 therein, and a slidable barrel part 34 mounted slidably on the stationary barrel part 32. The screw-driving shaft 33 is operably connected to a motor 311 that is disposed in the gun housing 31 such that the screw-driving shaft 33 rotates upon activation of the motor 311. The slidable barrel part 34 defines a screw-receiving chamber 341 for receiving a screw 411 that is detachably retained on a belt 41 and that is fed into the screw-receiving chamber 341 in a transverse direction relative to an axis (x) of the screw-driving shaft 33 in such a manner that the screw 411 is driven by the screw-driving shaft 33 upon operation of the screw driving gun. The screw 413 extends out of the slidable barrel part 34 upon sliding movement of the slidable barrel part 34 toward the gun housing 31.

The tubular member 21 has a coupling end 217 connected co-axially to the slidable barrel part 34 through a coupler tube 2" for co-movement therewith relative to the screw 411, a discharge end 218 opposite to the coupling end 217, and a peripheral wall 211 extending between the discharge and coupling ends 218, 217. The peripheral wall 211 of the tubular member 21 defines a screw-guiding chamber 212 therein. The tubular member 21 is slidable together with the slidable barrel part 34 relative to the screw 411 along the axis (X) to a discharging position, in which the screw 411 extends into the screw-guiding chamber 212 from the screw-receiving chamber 341, and in which the screw 411 will be driven by the screw-driving shaft 33 upon activation of the motor 311.

Figure 5:
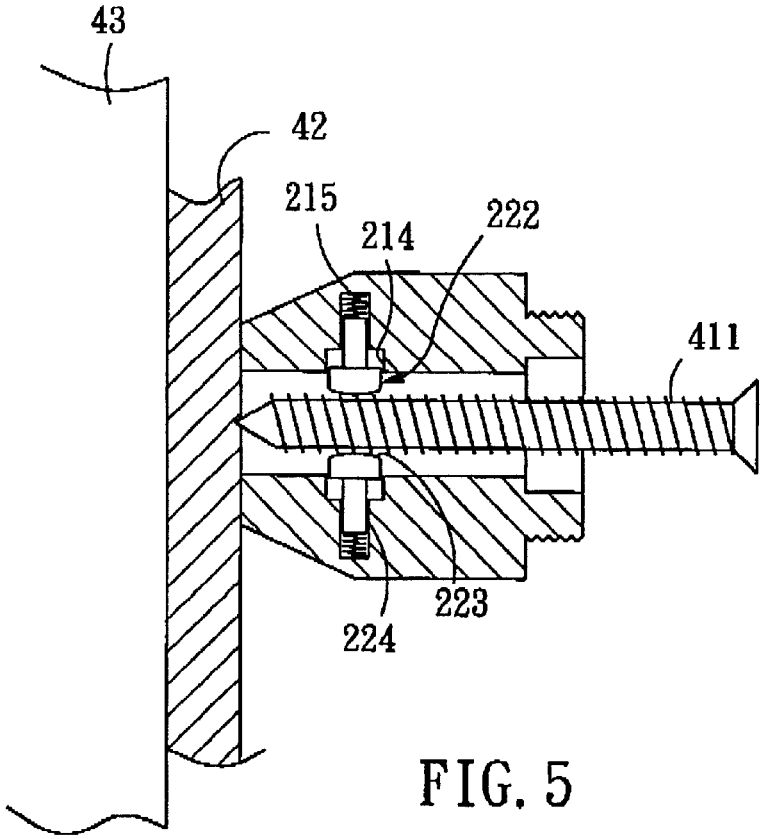
FIG. 5 is a sectional view of the first preferred embodiment, illustrating how a screw of a medium size is positioned between two screw-holding units of the first preferred embodiment.

The opposing spring-biased screw-holding units 22 are disposed within the screw-guiding chamber 212, and are mounted on the peripheral wall 211 of the tubular member 21. The spring-biased screw-holding units 22 include first and second urging members 23, and first and second screw-holding members 222 which radially project from the peripheral wall 211 into the screw-guiding chamber 212 and which are respectively urged by the first and second urging members 23 to move toward each other in such a manner that when the tubular member 21 is moved to the discharging position due to pushing of the discharge end 218 of the tubular member 21 against a workpiece 42 disposed on a wall structure 43 (see FIG. 5), the first and second screw-holding members 222 come into contact with and are pushed by the screw 411 to move radially away from each other against urging action of the first and second urging members 23 and that the first and second screw-holding members 222 are urged by the first and second urging members 23 to abut against the screw 411, thereby positioning the screw 411 at a center position, in which the screw 411 extends along the axis (X). Under this condition, the workpiece 42 will be fastened onto the wall structure 43 by the screw 411 upon activation of the motor 311 (see FIG. 3.).

The peripheral wall 211 of the tubular member 21 has opposite inner and outer surfaces 211", 211'. The peripheral wall 11 is formed with two diametrically disposed counter-bores 213. Each of the counter-bores 213 is defined by a bore-confining wall that extends radially inward from the inner surface 211" thereof, and has an enlarged bore section 214 that is proximate to the screw-guiding chamber 212, and a narrow bore section 215 that is distal from the screw-guiding chamber 212 and that has a cross-section smaller than that of the enlarged bore section 214. Each of the first and second urging members 23 is disposed in the narrow bore section 215 of a respective one of the counter-bores 213. Each of the first and second screw-holding members 222 has a cylindrical rod portion 224 that extends into the narrow bore section 215 of the respective one of the counter-bores 213 to abut against a respective one of the first and second urging members 23, and an enlarged head portion 223 that is connected to the cylindrical rod portion 224, and that is disposed in the screw-guiding chamber 212 to abut against the screw 411 when the tubular member 21 is moved to the discharging position. The enlarged head portion 223 of each of the first and second screw-holding members 222 is movable into the enlarged bore section 214 of the respective one of the counter-bores 213. Preferably, the enlarged head portion 223 of each of the first and second screw-holding members 222 has a curved surface for contacting the screw 411 when the tubular member 21 is at the discharging position.

Figure 6:
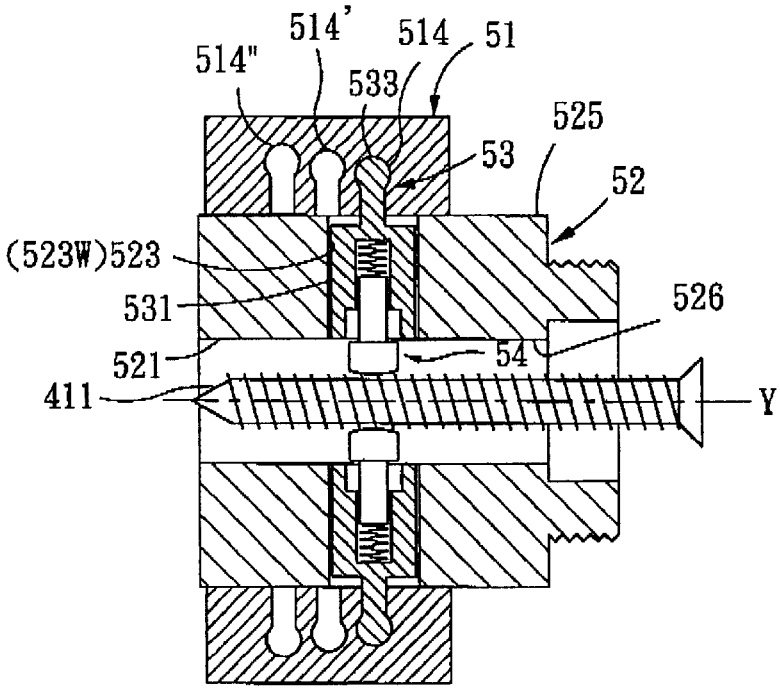
FIG. 6 is a sectional view of the second preferred embodiment of a screw positioning device according to the present invention.
Figure 7:
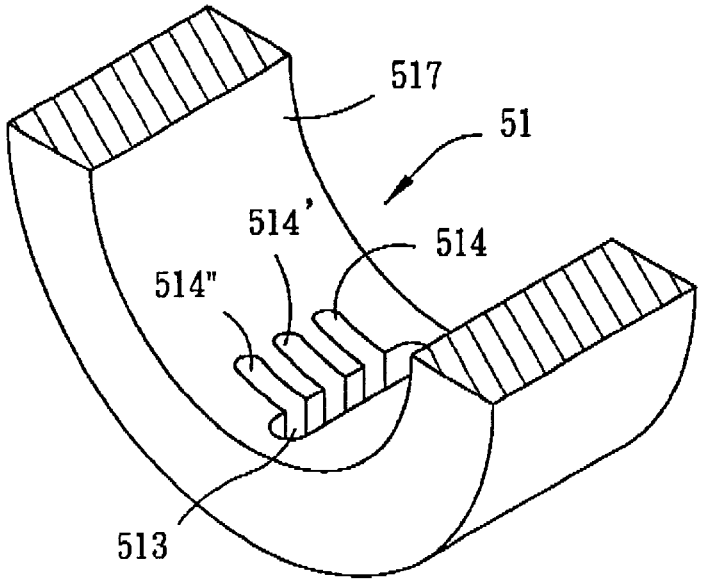
FIG. 7 is an enlarged and fragmentary sectional view of a position-adjusting sleeve employed in the second preferred embodiment, illustrating the relationship between retaining blind bores and slots formed in the position-adjusting sleeve.

Referring to FIGS. 6 and 7 the second preferred embodiment of a screw positioning device according to the present invention is shown to have a construction similar to that of the previous embodiment. The main differences are that the peripheral wall 521 of the tubular member 52 is formed with at least two diametrically disposed through-holes 523. Each of the through-holes 523 is defined by a hole-confining wall 523W that extends radially through the inner and outer surfaces 526, 525 of the peripheral wall 521. First and second seats 53 are respectively and glidably disposed within the through-holes 523 in the tubular member 52. Each of the first and second seats 53 ban a cylindrical part 531 that is received in a respective one of the through-holes 523 in the tubular member 52 and that has opposite inner and outer ends, and an abutting protrusion 533 that extends radially and outwardly from the outer end of the cylindrical part 531 through the outer surface 525 of the peripheral wall 521. A position-adjusting sleeve 51 is sleeved rotatably and slidably on the tubular member 52 in such a manner that the position-adjusting sleeve 51 it slidable on the tubular member 52 in an axial direction relative to the axis (X) between first and second axial positions, and is rotatable about the axis (X) between first and second angular positions. The position-adjusting sleeve 51 slidably contacts the outer surface 525 of the peripheral wall 521, and is formed with two diametrically disposed first retaining blind bores 514 of a first depth that extends radially from an inner wall surface 517 of the position-adjusting sleeve 51, two diametrically disposed second retaining blind bores 514' of a second depth that extends radially from the inner wall surface 517 of the position-adjusting sleeve 51 and that is different from the first depth, and two diametrically disposed third retaining blind bores 514" of a third depth that extends radially from the inner wall surface 517 of the position-adjusting sleeve 51 and that is different from the first and second depths. The different depths of the first, second and third retaining blind bores 514, 514', 514" correspond to screws of different diameters. The inner wall surface 517 of the position-adjusting sleeve 51 is further formed with two diametrically disposed elongated slots 513.

For the sake of brevity of relationship between each of the first and second seats 53 and a selected one of the first, second and third retaining blind bores 514, 514', 514" will be described with reference to the first and second retaining blind bores 514, 514' only. Each of the first retaining blind bodes 514 is axially aligned with and is spaced apart from a respective one of the second retaining blind bores 514'.

Figure 8A:
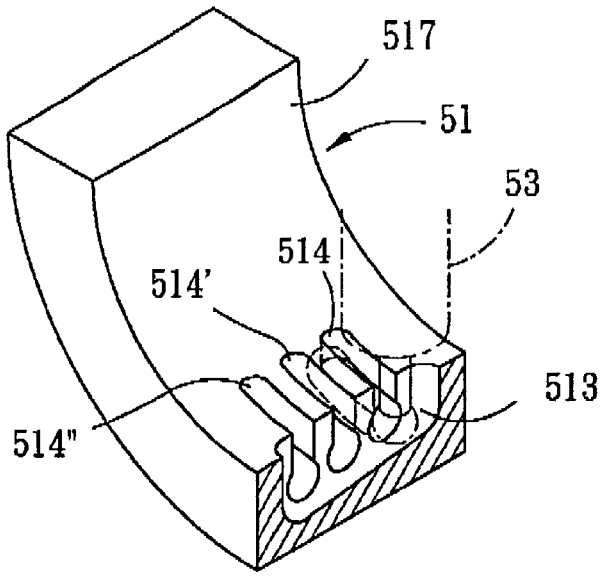
FIG. 8(A) is an enlarged and fragmentary sectional view of the position-adjusting sleeve of FIG. 7, illustrating the position of a seat in a slot when the sleeve is disposed on a tubular member at first axial and first angular positions.
Figure 8B:
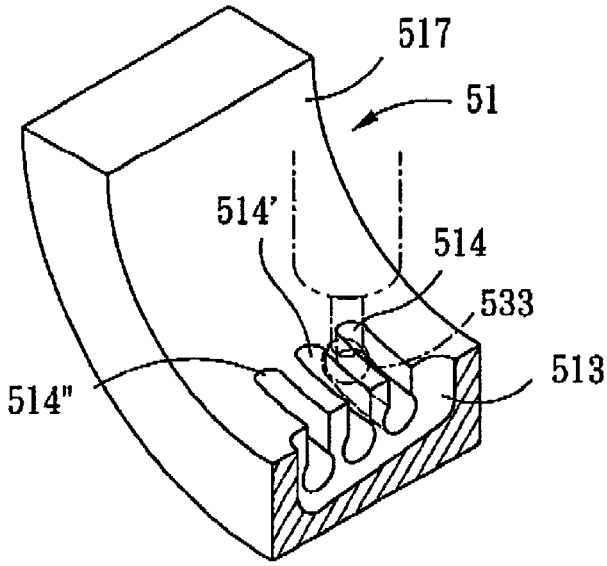
FIG. 8(B) is an enlarged and fragmentary sectional view of the position-adjusting sleeve of FIG. 7, illustrating the position of the seat in a retaining blind bore when the sleeve is disposed on the tubular member at the first axial position and a second angular position.

Each of the first and second retaining blind bores 514, 514' is defined by a bore-containing wall that extends radially from the inner wall surface 517 of the position-adjusting sleeve 51. Each of the elongated slots S13 extends in the axial direction, and is in spatial communication with a respective one of the first retaining blind bores 514 and a respective one of the second retaining blind bores 514' in a circumferential direction relative to the axis (X) in such a manner that the abutting protrusion 533 of each of the first and second seats 53 projects Into a respective one the elongated slots 513 and is registered with a respective one of the first retaining blind bores 514. (see FIG. 8(A)) when the position-adjusting sleeve 51 is positioned at the first axial position and the first angular position, and that the abutting protrusion 533 of each of the first and second seats 53 projects into the respective one of the first retaining blind bores 514 and abuts against the bore-confining wall of the respective one of the first retaining blind bores 514 (see FIG. 8(B)) when the position-adjusting sleeve 51 is positioned at the first axial position and the second angular position, thereby positioning a screw with a smaller diameter between the first and second screw-holding members 54.

Figure 9:
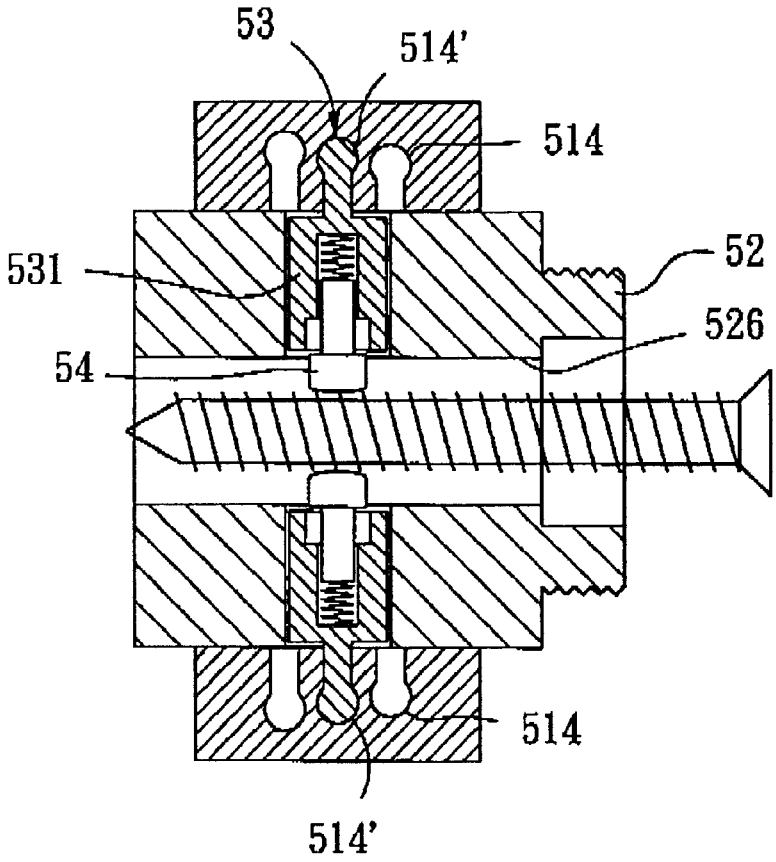
FIG. 9 is a sectional view of the second preferred embodiment, illustrating position of the seat when the position-adjusting sleeve is disposed on the tubular member at the second axial position and the second angular position.

In a similar manner, the abutting protrusion 533 of each of the first and second seats 53 projects into a respective one of the elongated slots 513, and is registered with a respective one of the second retaining blind bores 514' when the position-adjusting sleeve 51 is positioned at the second axial position and the first angular position, and that the abutting protrusion 533 of each of the first and second seats 53 projects into the respective one of the second retaining blind bores 514' and abuts against the bore-confining wall of the respective one of the second retaining blind bores 514' (see FIG. 9) when the position-adjusting sleeve 51 is positioned at the second axial position and the second angular position, thereby positioning a screw with a larger diameter between the first and second screw-holding members 54.

The inner end of the cylindrical part 531 of each of the first and second seats 53 is preferably formed with a counter-bore having a configuration similar to if that shown and described in the first preferred embodiment.

Since the spring-biased screw-holding units of the screw positioning device of the present invention can maintain the orientation of the screw to be fed along the axis of the screw-driving shaft, the aforesaid disadvantage of the prior art can be overcome.

With this invention thus explained, it is apparent that numerous modifications and variations can be made without departing from the scope and spirit of this invention. It is therefore intended that this invention be limited only as indicated in the appended claim.

We claim:

1. A screw positioning device for a screw driving gun that includes a gun housing, a screw-driving shaft, and a barrel unit, the barrel unit having a stationary barrel part secured to and projecting outwardly from the gun housing so as to define a shaft-receiving chamber for receiving the screw-driving shaft therein, and a slidable barrel part mounted on and slidable relative to the stationary barrel part, the slidable barrel part defining a screw-receiving chamber for receiving a screw that is detachably retained on a belt and that is fed into the screw-receiving chamber in a transverse direction relative to an axis of the screw-driving shaft, the screw being driven by the screw-driving shaft and extending out of the slidable barrel part upon sliding movement of the slidable barrel part toward the gun housing, said screw positioning device comprising:

a tubular member having a coupling end adapted to be connected co-axially to the slidable barrel part for co-movement therewith relative to the screw, a discharge end opposite to said coupling end, and a peripheral wall extending between said discharge and coupling ends and defining a screw-guiding chamber therein, said tubular member being slidable together with the slidable barrel part relative to the screw along the axis to a discharging position, in which the screw extends into said screw-guiding chamber; and at least two opposing spring-biased screw-holding units disposed within said screw-guiding chamber, mounted on said peripheral wall, and including first and second urging members and first and second screw-holding members which radially project from said peripheral wall into said screw-guiding chamber and which are respectively urged by said first and second urging members to move toward each other in such a manner that said first and second screw-holding members come into contact with the screw and are pushed by the screw to move radially away from each other against said first and second urging members and that said first and second screw-holding members are urged by said first and second urging members to abut against the screw when said tubular member is slid to said discharging position, thereby positioning the screw at a center position, in which the screw extends along the axis.

2. The screw positioning device as defined in claim 1, wherein said peripheral wall has opposite inner and outer surfaces, said peripheral wall being formed with two diametrically disposed counter-bores, each of said counter-bores being defined by a bore-confining wall that extends radially from said inner surface of said peripheral wall and having an enlarged bore section that is proximate to said screw-guiding chamber, and a narrow bore section that is distal from said screw-guiding chamber and that has a cross-section smaller than that of said enlarged bore section, each of said first and second urging members being disposed in said narrow bore section of a respective one of said counter-bores, each of said first and second screw-holding members having a cylindrical rod portion that extends into said narrow bore section of a respective one of said counter-bores to abut against a respective one of said urging members, and an enlarged head portion that is connected to said cylindrical rod portion, that is disposed in said screw-guiding chamber to abut against the screw when said tubular member is moved to said discharging position, and that is movable into said enlarged bore section of the respective one of said counter-bores.

3. The screw positioning device as defined in claim 2, wherein said enlarged head portion of each of said first and second screw-holding members has a curved surface that is adapted to contact the screw when said tubular member is moved to said discharging position.

4. The screw positioning device as defined in claim 1, wherein said peripheral wall of said tubular member has opposite inner and outer surfaces, and is formed with two diametrically disposed through-holes, each of which is confined by a hole-defining wall that extends radially through said inner and outer surfaces of said peripheral wall, said screw positioning device further comprising first and second seats that are respectively and slidably disposed in said through-holes, said first and second seats being slidable in said through-holes in a radial direction relative to said axis, each of said first and second seats having a cylindrical part that is received in respective one of said through-holes and that has an inner end, an outer end which is opposite to said inner end, and an abutting protrusion that extends radially and outwardly from said outer end of said cylindrical part through said outer surface of said peripheral wall of said tubular member, said screw positioning device further comprising a position-adjusting sleeve sleeved rotatably and slidably on said tubular member, and having an inner wall surface that slidably contacts said outer surface of said peripheral wall and that is formed with two diametrically disposed first retaining blind bores of a first depth that extends radially from said inner wall surface of said position-adjusting sleeve, two diametrically disposed second retaining blind bores of a second depth that extends radially from said inner wall surface of said position-adjusting sleeve and that is different from said first depth, and two diametrically disposed elongated slots, each of said first retaining blind bores being axially aligned with and spaced apart from a respective one of said second retaining blind bores, each of said first and second retaining blind bores, being defined by a bore-confining wall, each of said elongated slots extending in an axial direction relative to said axis and being in spatial communication with a respective one of said first retaining blind bores and a respective one of said second retaining blind bores, said position-adjusting sleeve being slidable on said tubular member in said axial direction between first and second axial positions and being rotatable about the axis between first and second angular positions in such a manner that said abutting protrusion of each of said first and second seats projects into a respective one said elongated slots and is registered with a respective one of said first retaining blind bores when said position-adjusting sleeve is positioned at said first axial position and said first angular position, that said abutting protrusion of each of said first and second seats projects into the respective one of said first retaining blind bores and abuts against said bore-confining wall of the respective one of said first retaining blind bores when said position-adjusting sleeve is positioned at said first axial position and said second angular position, that said abutting protrusion of each of said first and second seats projects into a respective one of said elongated slots and is registered with a respective one of said second retaining blind bores when said position-adjusting sleeve is positioned at said second axial position and said first angular position, and that said abutting protrusion of each of said first and second seats projects into the respective one of said second retaining blind bores and abuts against said bore-confining wall of the respective one of said second retaining blind bores when said position-adjusting sleeve is positioned at said second axial position and said second angular position.

5. The screw positioning device an defined in claim 4, wherein said cylindrical part of each of said first and second seats is formed with a counter-bore having an enlarged bore section proximate to said screw-guiding chamber and a narrow bore section that is distal from said screw-guiding chamber and that has a cross-section smaller than that of said enlarged bore section, each of said first and second urging members being disposed in said narrow bore section of a respective one of said counter-bores, each of said first and second screw-holding members having a cylindrical rod portion that extends into said narrow bore section of the respective one of said counter-bores to abut against a respective one of said urging members, and an enlarged head portion that is connected to said cylindrical rod portion, and that is disposed in said screw-guiding chamber to be adapted to abut against the screw when said tubular member is moved to said discharging position.

* * * * *